US009951543B1

(12) United States Patent
Guttery

(10) Patent No.: US 9,951,543 B1
(45) **Date of Patent: *Apr. 24, 2018**

(54) METHOD AND APPARATUS FOR ADJUSTABLE GATE LATCH

(71) Applicant: TAGLACO, LLC, Highland Village, TX (US)

(72) Inventor: Randall S. Guttery, Highland Village, TX (US)

(73) Assignee: TAGLACO, LLC, Highland Village, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/730,942

(22) Filed: Jun. 4, 2015

Related U.S. Application Data

(63) Continuation of application No. 13/633,265, filed on Oct. 2, 2012, now Pat. No. 9,109,377.
(Continued)

(51) Int. Cl.
*E05C 3/02* (2006.01)
*E05B 15/02* (2006.01)
(Continued)

(52) U.S. Cl.
CPC ..... *E05B 15/022* (2013.01); *E05B 15/0093* (2013.01); *E05B 15/024* (2013.01);
(Continued)

(58) Field of Classification Search
CPC .. E05B 15/024; E05B 15/025; E05B 15/0093; E05B 63/06; E05B 63/0056
(Continued)

(56) References Cited

U.S. PATENT DOCUMENTS 58,929 A 10/1866 Wood
86,217 A 1/1869 Davis
(Continued)

FOREIGN PATENT DOCUMENTS

CA 1046552 A1 * 1/1979 ..... E05B 15/0245
CA 2095989 A1 * 11/1994 ..... E05B 15/0006
(Continued)

*Primary Examiner* — Carlos Lugo
(74) *Attorney, Agent, or Firm* — Winstead PC

(57) ABSTRACT

An adjustable-latch system including an adjustable-receiver assembly and an adjustable-striker-bar assembly. The adjustable-receiver assembly includes a receiver sleeve having a pair of oppositely-disposed channels formed therein and a receiver slidably disposed within the pair of oppositely-disposed channels. A first plurality of fastening members mount the receiver sleeve. The adjustable-receiver assembly further includes a receiver-sleeve cap slidably disposed within the receiver sleeve. The adjustable-striker-bar assembly includes a mounting plate having a striker bar extending laterally therefrom, a second plurality of fastening members for mounting the mounting plate, and a striker-bar cap slidably coupled with the mounting plate. A position of the adjustable-receiver assembly may be adjusted relative to the adjustable-striker-bar assembly without removal of the first plurality of fastening members. A position of the adjustable-striker-bar assembly may be adjusted relative to the adjustable-receiver assembly without removal of the second plurality of fastening members.

18 Claims, 11 Drawing Sheets

Related U.S. Application Data

(60) Provisional application No. 61/599,280, filed on Feb. 15, 2012, provisional application No. 61/548,789, filed on Oct. 19, 2011.

(51) Int. Cl.

| | |
|---|---|
| *E05C 3/12* | (2006.01) |
| *E05B 63/00* | (2006.01) |
| *E05B 15/00* | (2006.01) |
| *E05B 63/06* | (2006.01) |

(52) U.S. Cl.
CPC ..... *E05B 15/025* (2013.01); *E05B 63/0056* (2013.01); *E05B 63/06* (2013.01)

(58) Field of Classification Search
USPC ..... 292/230, 231, 238, 341.18, 341.19, 292/DIG. 60
See application file for complete search history.

(56) References Cited

U.S. PATENT DOCUMENTS

| | | | | |
|---|---|---|---|---|
| 126,191 | A | 4/1872 | Dickey | |
| 148,662 | A | 3/1874 | Burr | |
| 394,685 | A | 12/1888 | Fether | |
| 1,082,121 | A | 12/1913 | Herman | |
| 1,873,528 | A | 8/1932 | Anstine | |
| 2,643,149 | A | 6/1953 | Mager | |
| 2,931,612 | A | 4/1960 | Graber | |
| 4,305,611 | A | 12/1981 | Robins | |
| 4,416,126 | A | 11/1983 | Remington | |
| 4,451,071 | A | 5/1984 | Striese et al. | |
| 4,690,440 | A | 9/1987 | Rogers | |
| 4,907,773 | A | 3/1990 | Menchetti et al. | |
| 5,352,001 | A | 10/1994 | Shieh | |
| 5,868,446 | A | 2/1999 | Rossmo | |
| 6,347,819 | B1 | 2/2002 | Plaxco | |
| 6,932,192 | B2 * | 8/2005 | Blythe | B63B 27/146 182/82 |
| 7,147,213 | B1 | 12/2006 | Amendola | |
| 7,883,124 | B2 | 2/2011 | Gephart et al. | |
| 8,272,169 | B2 | 9/2012 | Mahdi | |
| 8,579,340 | B2 | 11/2013 | Gledhill et al. | |
| 9,109,377 | B1 * | 8/2015 | Guttery | E05B 15/024 |
| 2002/0060460 | A1 | 5/2002 | DeSouza | |
| 2010/0045055 | A1 | 2/2010 | Taglianetti | |
| 2010/0156119 | A1 | 6/2010 | Mueller et al. | |

FOREIGN PATENT DOCUMENTS

| | | | | |
|---|---|---|---|---|
| CA | 2454213 | A1 * | 6/2005 | E05B 65/0007 |
| GB | 191505169 | A | 5/1915 | |

* cited by examiner

METHOD AND APPARATUS FOR ADJUSTABLE GATE LATCH

CROSS-REFERENCE TO RELATED APPLICATIONS

This application is a continuation of U.S. patent application Ser. No. 13/633,265, filed Oct. 2, 2012. U.S. patent application Ser. No. 13/633,265 claims priority to U.S. Provisional Patent Application No. 61/548,789, filed Oct. 19, 2011 and U.S. Provisional Patent Application No. 61/599,280, filed Feb. 15, 2012. U.S. patent application Ser. No. 13/633,265, U.S. Provisional Patent Application No. 61/548,789, and U.S. Provisional Patent Application No. 61/599,280 are incorporated herein by reference.

BACKGROUND

Field of the Invention

The present application relates generally to latch assemblies for gates and the like and more particularly, but not by way of limitation, to latch assemblies utilizing an adjustable receiver and an adjustable striker bar that corrects misalignment of gates and the like.

History of the Related Art

It is often desirable to surround property with a fence or other barrier to entry. In such cases, it is necessary to have a gate that attaches securely to a fence post or other stationary component. Such an arrangement requires a latch assembly. A latch assembly generally includes a striker bar that moves in a horizontal plane with the gate and a stationary receiver that receives and holds the striker bar. The striker bar is typically mounted on the gate and the stationary receiver is typically mounted on the fence post or other stationary component. The stationary receiver includes a latch lever. The latch lever typically moves upwardly in a vertical plane as the striker bar makes contact. Once the striker bar is coupled with the stationary receiver, the latch lever moves downwardly in a vertical plane to secure the gate to the fence post or other stationary component.

Frequently, gates become misaligned such that the striker bar will not nest securely in the stationary receiver. Such misalignment is often caused by weather, seasonal changes, shifting soil, compromised gate hardware, warping of fencing materials, or other causes. In such cases, it becomes difficult or impossible to safely and securely latch the gate, thereby allowing intrusion into an otherwise protected area.

To correct such misalignment, frequent adjustments to gate hinges, fence posts, striker bars and/or stationary receivers are often performed. Over time, these adjustments expand screw holes in the gate and/or the fence posts, such that one or more pieces of latch-assembly hardware cannot be reattached.

SUMMARY

The present invention relates generally to latch assemblies. In one aspect, the present invention relates to an adjustable-latch system. The adjustable-latch system includes an adjustable-receiver assembly and an adjustable-striker-bar assembly. The adjustable-receiver assembly includes a receiver sleeve and a receiver slidably disposed within the receiver sleeve. A first plurality of fastening members mount the receiver sleeve. The adjustable-receiver assembly further includes a receiver-sleeve cap slidably disposed within the receiver sleeve. The adjustable-striker-bar assembly includes a mounting plate having a striker bar extending laterally therefrom, a second plurality of fastening members that mount the mounting plate, and a striker-bar cap slidably coupled with the mounting plate. A vertical position of the adjustable-receiver assembly may be adjusted relative to the adjustable-striker-bar assembly without removal of the first plurality of fastening members. A vertical position of the adjustable-striker-bar assembly may be adjusted relative to the adjustable-receiver assembly without removal of the second plurality of fastening members.

In another aspect, the present invention relates to a method for adjusting an adjustable-receiver assembly. The method includes removing a receiver-sleeve cap from a receiver sleeve and removing a receiver from the receiver sleeve. The method further includes loosening a first plurality of fastening members sufficiently to allow vertical movement of the receiver sleeve and positioning the receiver sleeve relative to a striker bar. The method further includes tightening the first plurality of fastening members to secure the receiver sleeve, placing the receiver within the receiver sleeve, and assembling the receiver-sleeve cap to the receiver sleeve.

In another aspect, the present invention relates to a method for adjusting an adjustable-striker-bar assembly. The method includes removing a striker-bar cap from a mounting plate and loosening a first plurality of fastening members sufficiently to allow vertical movement of the mounting plate. The method further includes positioning a striker bar extending from the mounting plate relative to a receiver, tightening the first plurality of fastening members to secure the mounting plate, and assembling the striker-bar cap to the mounting plate.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
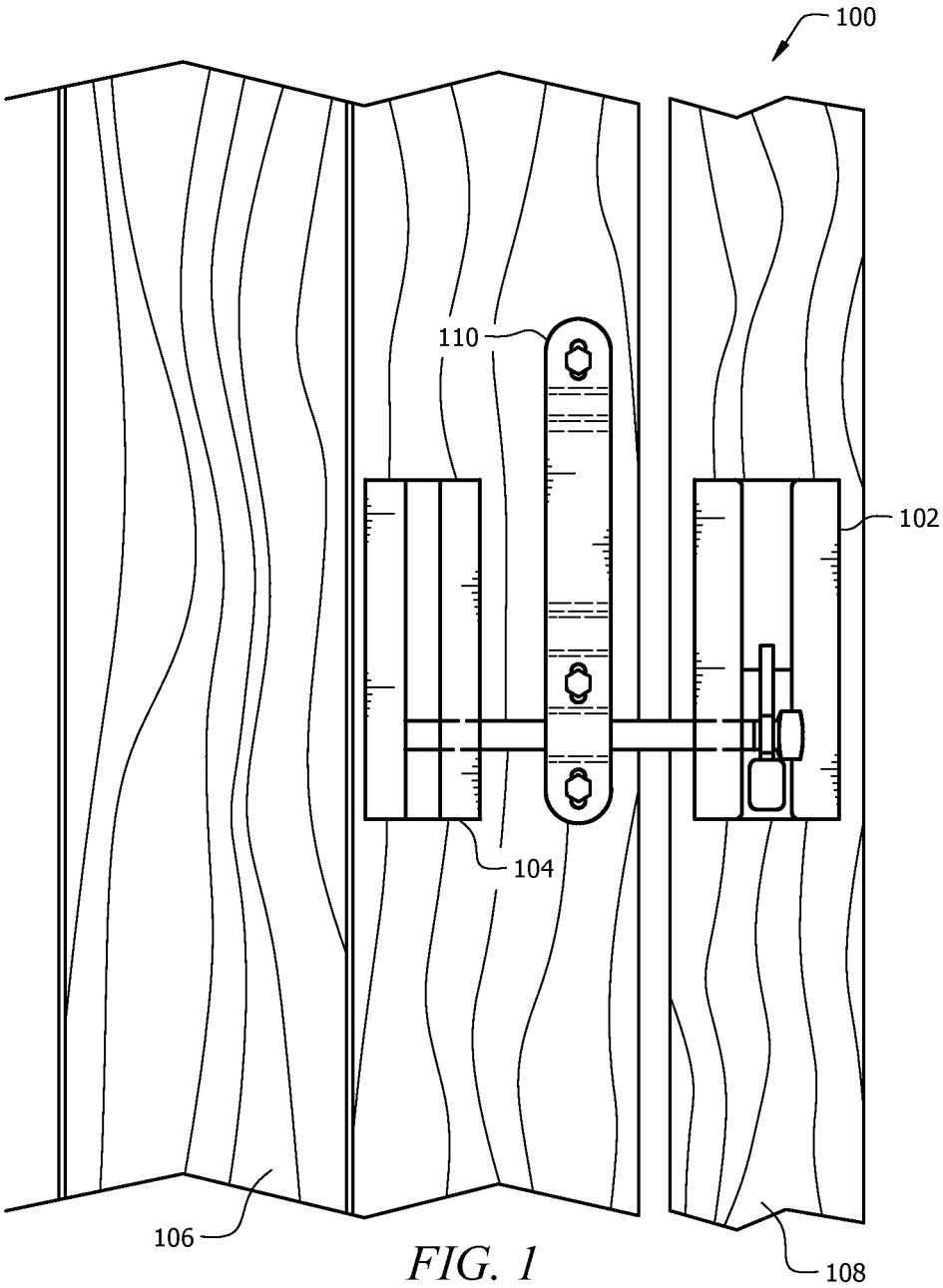
FIG. 1 is a plan view of an adjustable-latch system according to an exemplary embodiment.

FIG. 1 is a plan view of an adjustable-latch system according to an exemplary embodiment. An adjustable-latch system 100 includes at least one of an adjustable-receiver assembly 102, an adjustable-striker-bar assembly 104, and an adjustable handle 110. In a typical embodiment, the adjustable-striker-bar assembly 104 is mounted to a movable member 106 such as, for example, a gate and the adjustable-receiver assembly 102 is mounted to a fixed member 108 such as, for example, a fence post. According to alternative embodiments, however, the adjustable-receiver assembly 102 may be mounted to the movable member 106 while the adjustable-striker-bar assembly 104 may be mounted to the fixed member 108.

Figure 2:
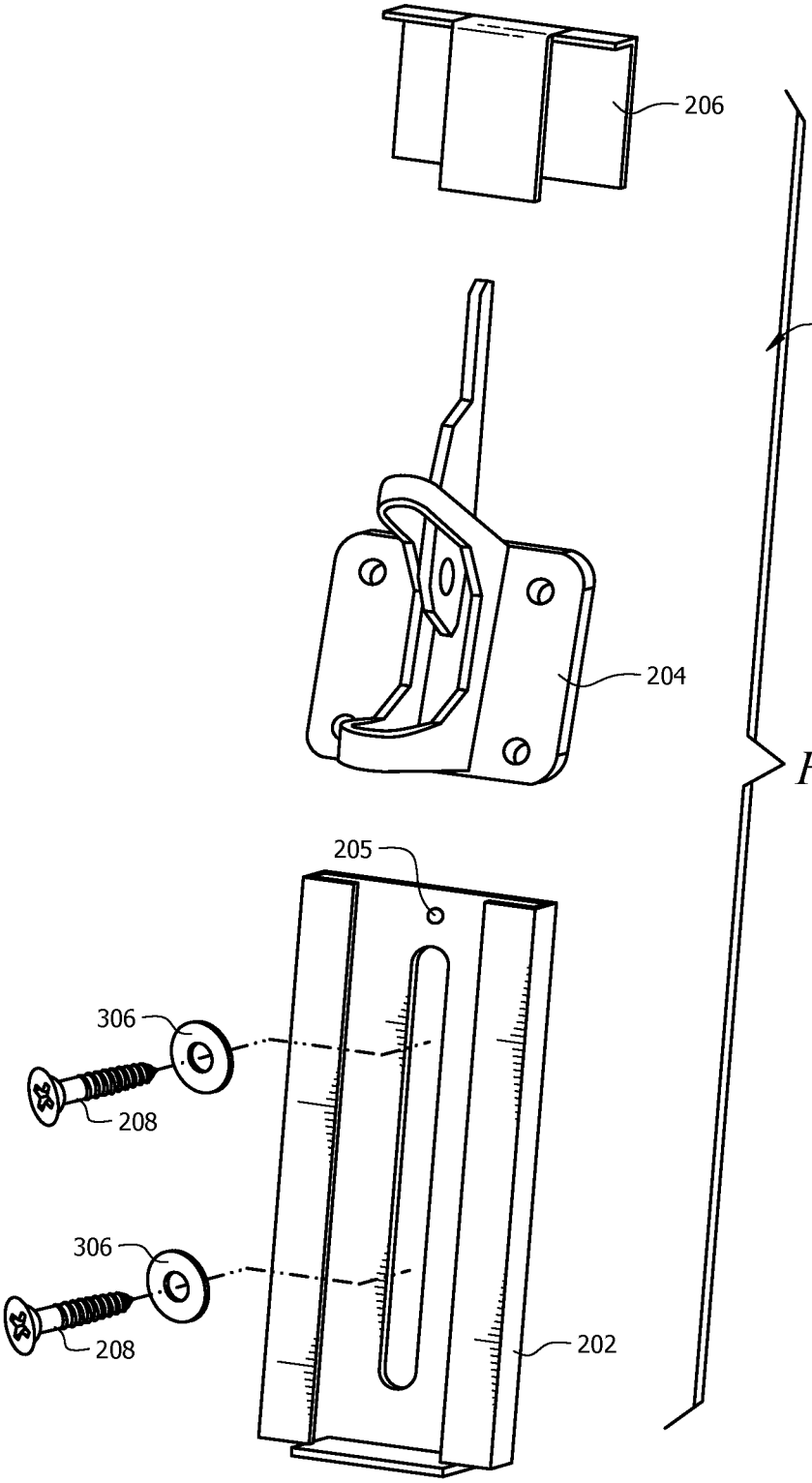
FIG. 2 is an exploded perspective view of an adjustable-receiver assembly according to an exemplary embodiment.

FIG. 2 is an exploded perspective view of an adjustable-receiver assembly according to an exemplary embodiment. The adjustable-receiver assembly 102 includes a receiver sleeve 202, a receiver 204, a receiver-sleeve cap 206, and a plurality of fastening members 208. In a typical embodiment, the plurality of fastening members 208 may be, for example, a plurality of screws, lags, bolts, rivets, or other fasteners. In a typical embodiment, the receiver sleeve 202 is mounted to the fixed member 108 (shown in FIG. 1) by the plurality of fastening members 208. The plurality of fastening members 208 include a plurality of washers 306. The plurality of washers 306 facilitate engagement of the plurality of fastening members 208 with the receiver sleeve 202. The receiver 204 is slidably disposed within the receiver sleeve 202 such that the receiver 204 may move in a vertical direction while assembled with the receiver sleeve 202. In this sense, the receiver 204 is not fixedly mounted to the fixed member 108 or the receiver sleeve 202. Thus, vertical positioning of the receiver 204 may be adjusted to compensate for misalignment with the adjustable-striker-bar assembly 104 (shown in FIG. 1). The receiver-sleeve cap 206 is slidably disposed within the receiver sleeve 202 above the receiver 204. A pilot hole 205 is formed in the receiver sleeve 202. In a typical embodiment, the pilot hole 205 allows a user to mark a location of required mounting holes in, for example, the fixed member 108 prior to installation of the adjustable-receiver assembly 102.

Figure 3A:
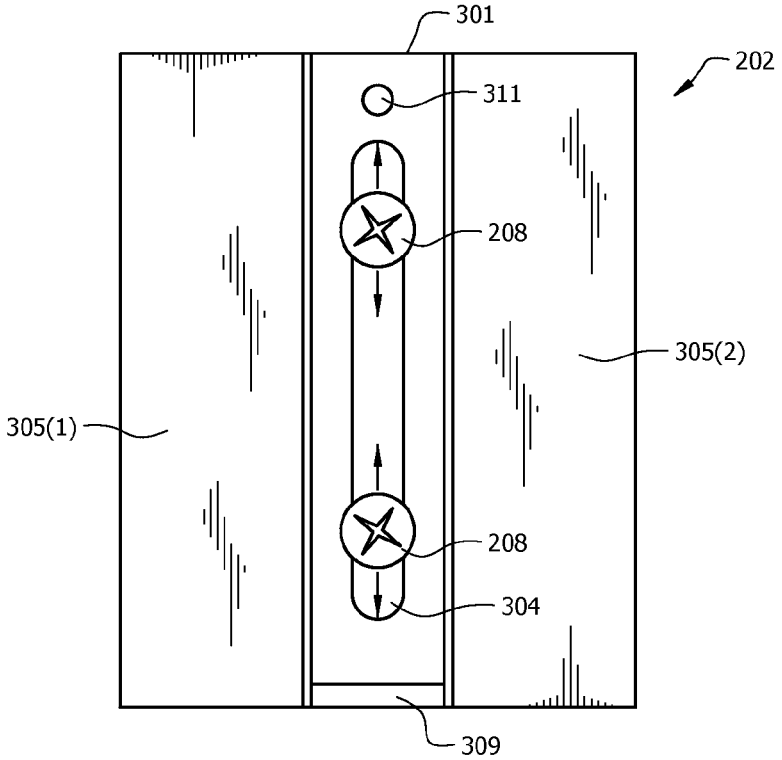
FIG. 3A is a front view of a receiver sleeve according to an exemplary embodiment.
Figure 3B:
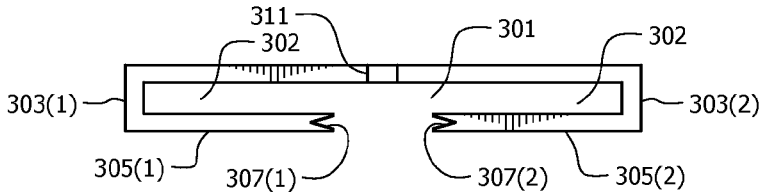
FIG. 3B is a top view of the receiver sleeve of FIG. 3A according to an exemplary embodiment.

FIG. 3A is a front view of a receiver sleeve according to an exemplary embodiment. FIG. 3B is a top view of a receiver sleeve according to an exemplary embodiment. Referring now to FIGS. 3A-3B, the receiver sleeve 202 includes a back plate 301, a first side plate 303(1), a second side plate 303(2), a first front plate 305(1), and a second front plate 305(2). The first side plate 303(1) and the second side plate 303(2) are oriented generally orthogonal to the back plate 301. The first front plate 305(1) and the second front plate 305(2) are oriented generally orthogonal to the first side plate 303(1) and the second side plate 303(2), respectively. The first front plate 305(1) has a first groove 307(1) formed in an edge region thereof. Likewise, the second front plate 305(2) has a second groove 307(2) formed in an edge region thereof. A bottom flange 309 is oriented generally orthogonal to the back plate 301. In a typical embodiment, the bottom flange 309 supports the receiver 204 (shown in FIG. 2)

Still referring to FIGS. 3A and 3B, the back plate 301, the first side plate 303(1), the second side plate 303(2), the first front plate 305(1), and the second front plate 305(2) form a pair of oppositely-disposed channels 302. The pair of oppositely-disposed channels 302 receive corresponding edges of the receiver 204 (shown in FIG. 2). The pair of oppositely-disposed channels 302 restrain the receiver 204 from moving in a direction generally orthogonal to the back plate 301; however, the pair of oppositely-disposed channels 302 permit the receiver 204 to slidably move in a vertical direction generally parallel to the back plate 301. In a typical embodiment, the receiver sleeve 202 is constructed of, for example, a metallic material such as, for example, aluminum, steel, or other metallic material; however, other appropriate rigid materials may be utilized.

Still referring to FIG. 3A, a vertically-oriented slot 304 is formed in the back plate 301. The vertically-oriented slot 304 facilitates securement of the receiver sleeve 202 with the fixed member 108 (shown in FIG. 1). The plurality of fastening members 208 are received through the vertically-oriented slot 304 and engage the fixed member 108. A pilot hole 311 is formed in the back plate 301 slightly above the vertically-oriented slot 304. In a typical embodiment, the pilot hole 311 allows a user to mark a location of required mounting holes in, for example, the fixed member 108 prior to installation of the receiver sleeve 202.

Figure 3C:
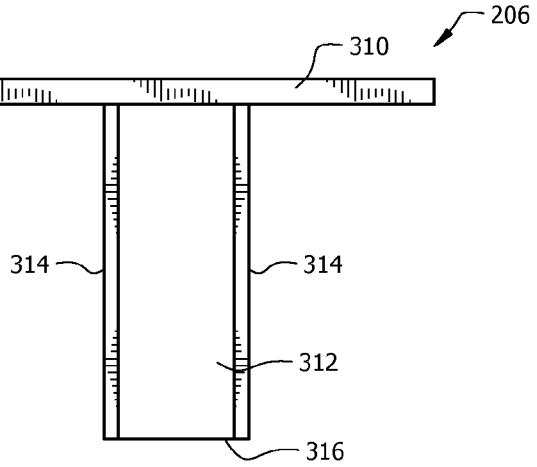
FIG. 3C is a front view of a receiver-sleeve cap for use with the receiver sleeve of FIG. 3A according to an exemplary embodiment.

FIG. 3C is a front view of a receiver-sleeve cap according to an exemplary embodiment. The receiver-sleeve cap 206 includes a generally-planar top plate 310 and a vertical plate 312. The generally-planar top plate 310 is of a width approximately equal to a distance between the first side plate 303(1) and the second side plate 303(2) (shown in FIGS. 2-3B). The generally-planar top plate 310 is of a depth approximately equal to a depth of the first side plate 303(1) and the second side plate 303(2) (shown in FIGS. 3A-3B). The vertical plate 312 is coupled generally perpendicularly to the generally-planar top plate 310. The vertical plate 312 includes a width approximately equal to a distance between the first front plate 305(1) and the second front plate 305(2) (shown in FIG. 3A-3B). Opposite edge regions 314 of the vertical plate 312 are tapered and are received into the first groove 307(1) and the second groove 307(2) (shown in FIG. 3B), respectively. The vertical plate 312 is of a length such that, when the receiver-sleeve cap 206 and the receiver 204 (shown in FIG. 2) are installed with the receiver sleeve 202 (shown in FIG. 2), a bottom region 316 of the vertical plate 312 contacts the receiver 204.

Referring now to FIGS. 1-3C, during operation, the adjustable-receiver assembly 102 may be adjusted to compensate for misalignment with, for example, the adjustable-striker-bar assembly 104. First, the receiver-sleeve cap 206 is moved in a vertical direction relative to the receiver sleeve 202 until the receiver-sleeve cap 206 is fully disengaged from the receiver sleeve 202. After the receiver-sleeve cap 206 is removed, the receiver 204 is moved in the vertical direction relative to the receiver sleeve 202 until the receiver 204 is fully disengaged from the receiver sleeve 202. After the receiver 204 is removed, the plurality of fastening members 208 are sufficiently loosened to allow the receiver sleeve 202 to slidably move in a vertical direction relative to the fixed member 108. The plurality of fastening members 208 are not fully disengaged from the fixed member 108 or the receiver sleeve 202. After loosening the plurality of fastening members 208, the receiver sleeve 202 is positioned such that the receiver 204 is aligned with a striker-bar such as, for example, the adjustable-striker-bar assembly 104. The plurality of fastening members 208 are then tightened to secure the receiver sleeve 202 to the fixed member 108. After the plurality of fastening members 208 are tightened, the receiver 204 is placed into the receiver sleeve 202. After the receiver 204 is placed in the receiver sleeve 202, the receiver-sleeve cap 206 is re-engaged with the receiver sleeve 202. In this manner, the adjustable-receiver assembly 102 may be adjusted to compensate for misalignment without complete removal of the plurality of fastening members 208.

Figure 4A:
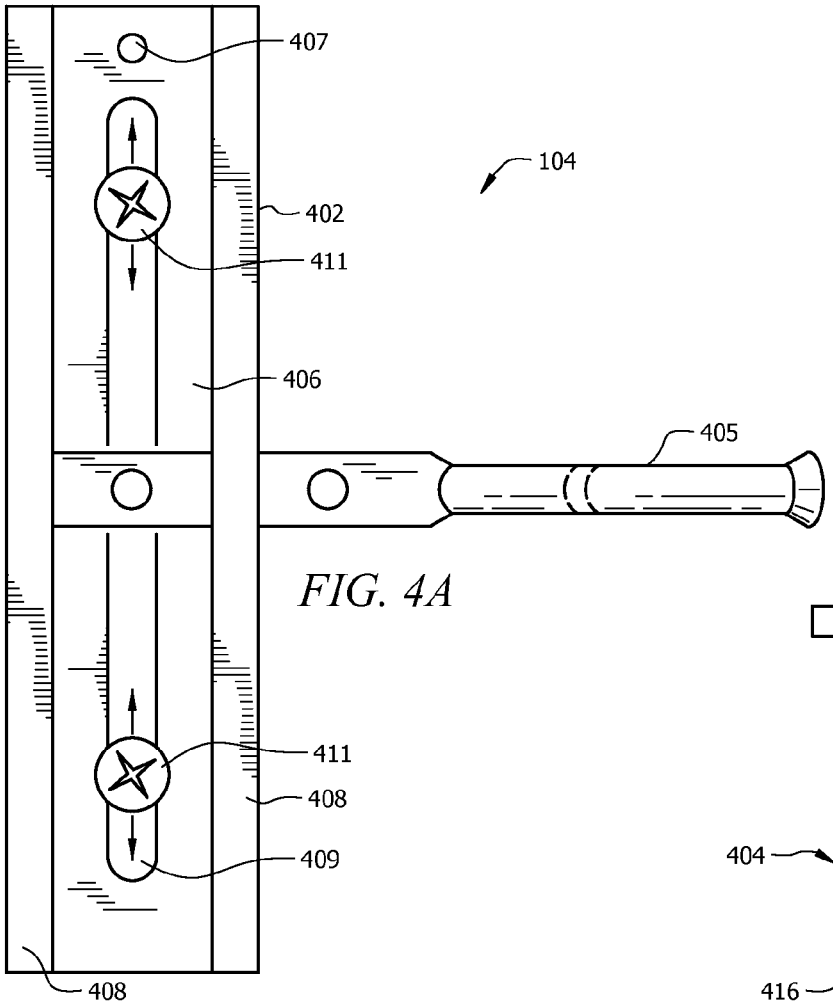
FIG. 4A is a front view of an adjustable-striker-bar assembly according to an exemplary embodiment.
Figure 4B:
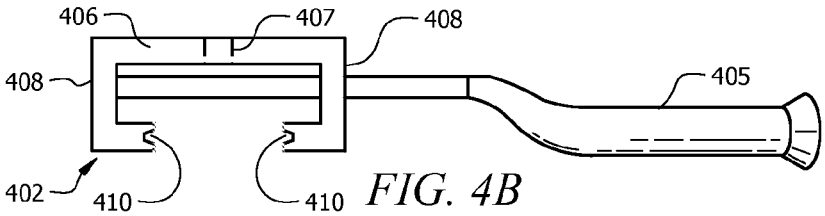
FIG. 4B is a bottom view of the adjustable-striker-bar assembly of FIG. 4A according to an exemplary embodiment.

FIG. 4A is a front view of an adjustable-striker-bar assembly according to an exemplary embodiment. FIG. 4B is a bottom view of the adjustable-striker-bar assembly of FIG. 4A according to an exemplary embodiment. Referring to FIGS. 4A-4B, the adjustable-striker-bar assembly 104 includes a mounting plate 402, a striker-bar cap 404 (shown in FIG. 4C), and a striker bar 405. The mounting plate 402 includes a rear plate 406 and a pair of flanges 408. The pair of flanges 408 are oriented generally orthogonal to the rear plate 406. Each flange of the pair of flanges 408 includes a channel 410 (shown in FIG. 4B) formed therein. The striker bar 405 extends laterally from the mounting plate 402 in a direction generally orthogonal to the mounting plate 402. A vertical opening 409 is formed in the rear plate 406. A plurality of fastening members 411 extend through the vertical opening 409 and secure the mounting plate 402 to the movable member 106 (shown in FIG. 1). In a typical embodiment, the plurality of fastening members 411 may be, for example, a plurality of screws, lags, bolts, rivets, or other fasteners. In an exemplary embodiment, the mounting plate 402 has a width on the order of approximately 1 inch and a length on the order of approximately 4 inches; however, other dimensional variations may be utilized. In a typical embodiment, the adjustable-striker-bar assembly 104 is used with fences constructed of materials such as, for example, wrought iron; however, other arrangements could be utilized. A pilot hole 407 is formed in the mounting plate 402 slightly above the vertical opening 409. In a typical embodiment, the pilot hole 407 allows a user to mark a location of required mounting holes in, for example, the movable member 106 prior to installation of the adjustable-striker-bar assembly 104.

Figure 4C:
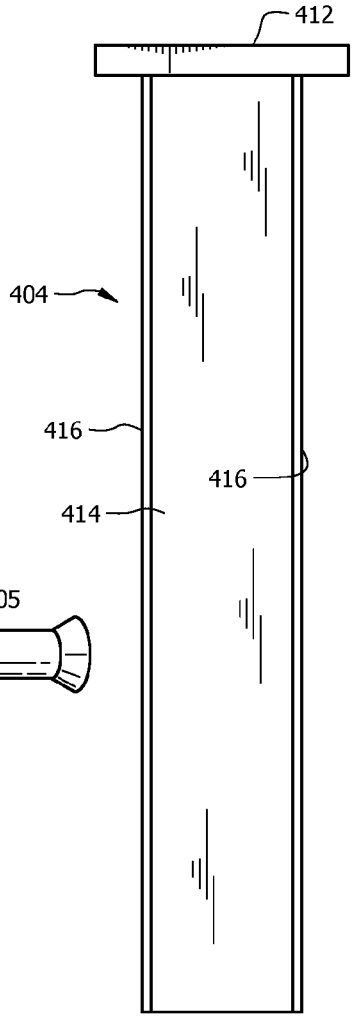
FIG. 4C is a side view of a striker-bar cap for use with the striker-bar assembly of FIG. 4A according to an exemplary embodiment.

FIG. 4C is a side view of a striker-bar cap according to an exemplary embodiment. The striker-bar cap 404 includes a top region 412 and a front region 414. The top region 412 is of a width generally equal to a distance between the pair of flanges 408 (shown in FIGS. 4A-4B). The top region 412 is of a depth generally equal to a depth of each flange of the pair of flanges 408. The front region 414 is coupled to, and is generally orthogonal to, the top region 412. The front region 414 is of a length generally equal to a length of the mounting plate 402 (shown in FIG. 4A); however, other lengths may be utilized. The striker-bar cap 404 is slidably engaged with the mounting plate 402 such that oppositely-disposed tapered edges 416 of the front region 414 engage the channel 410 formed in each flange of the pair of flanges 408.

Still referring to FIGS. 4A-4C, during operation, the adjustable-striker-bar assembly 104 may be adjusted to compensate for misalignment with, for example, the adjustable-receiver assembly 102. First, the striker-bar cap 404 is slidably moved in a vertical direction until the striker-bar cap 404 is fully disengaged from the mounting plate 402. After removal of the striker-bar cap 404, the plurality of fastening members 411 are sufficiently loosened to allow the mounting plate 402 to slidably move in the vertical direction relative to the movable member 106 (shown in FIG. 1). The plurality of fastening members 411 are not fully disengaged from the movable member 106 or the mounting plate 402. After loosening the plurality of fastening members 411, the mounting plate 402 is vertically positioned such that the striker bar 405 is aligned with a receiver such as, for example, the receiver 204 (shown in FIG. 2). After positioning the mounting plate 402, the plurality of fastening members 411 are then tightened to secure the mounting plate 402. The striker-bar cap 404 is then re-engaged with the mounting plate 402. In this manner, the adjustable-striker-bar assembly 104 may be adjusted to compensate for misalignment with the adjustable-receiver-assembly 102 without complete removal of the plurality of fastening members 411.

Figure 4D:
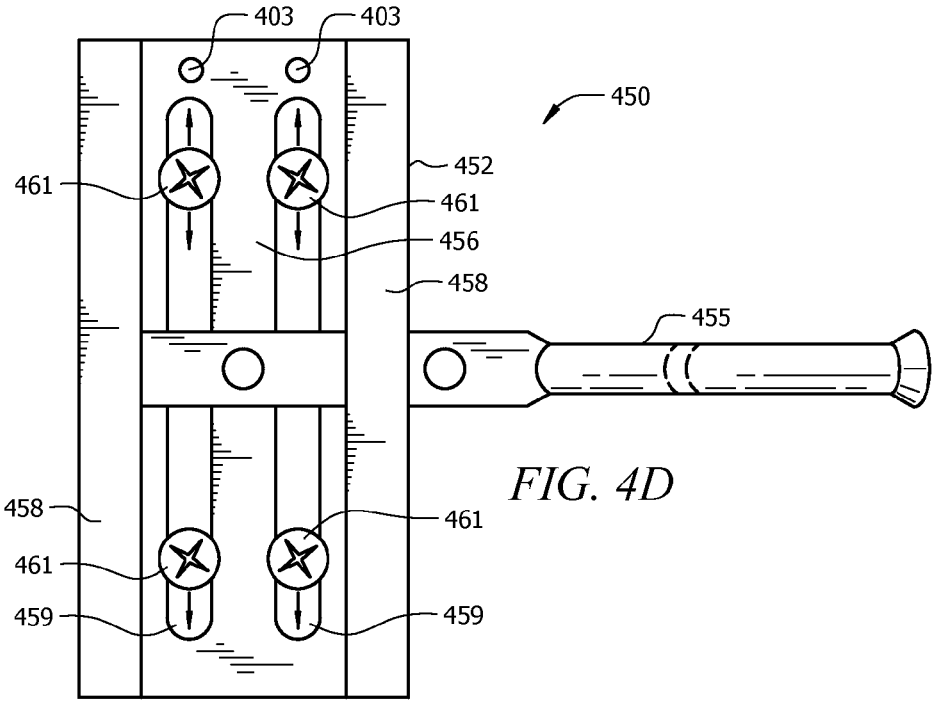
FIG. 4D is a front view of an adjustable-striker-bar assembly according to an exemplary embodiment.
Figure 4E:
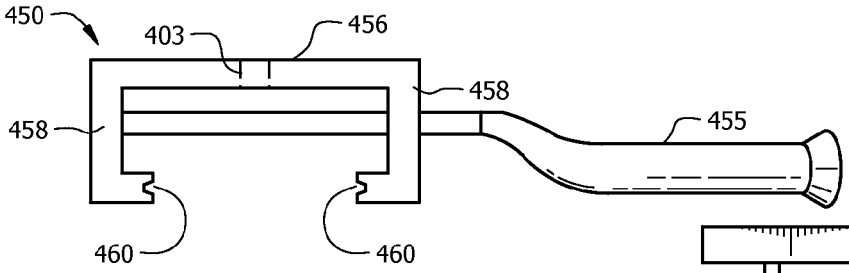
FIG. 4E is a bottom view of the adjustable-striker-bar assembly of FIG. 4D according to an exemplary embodiment.

FIG. 4D is a front view of an adjustable-striker-bar assembly according to an exemplary embodiment. FIG. 4E is a bottom view of the adjustable-striker-bar assembly of FIG. 4D according to an exemplary embodiment. Referring now to FIGS. 4D-4E, an adjustable-striker-bar assembly 450 includes a mounting plate 452, a striker-bar cap 454 (shown in FIG. 4F), and a striker bar 455. The mounting plate 452 includes a rear plate 456 and a pair of flanges 458. The pair of flanges 458 are oriented generally orthogonal to the rear plate 456. Each flange of the pair of flanges 458 has a channel 460 (shown in FIG. 4E) formed therein. The striker bar 455 extends laterally from the mounting plate 452 in a direction generally orthogonal to the mounting plate 452. A pair of parallel vertical openings 459 are formed in the rear plate 456. A plurality of fastening members 461 extend through the pair of parallel vertical openings 459 and secure the mounting plate 452 to the movable member 106 (shown in FIG. 1). In a typical embodiment, the plurality of fastening members 461 may be, for example, a plurality of screws, lags, bolts, rivets, or other fasteners. In an exemplary embodiment, the mounting plate 452 has a width on the order of approximately 2 inches and a length on the order of approximately 4.5 inches; however, other dimensional variations may be utilized. In a typical embodiment, the adjustable-striker-bar assembly is used with fences constructed of a material such as, for example, wood; however, other arrangements could be utilized. A pair of pilot holes 403 is formed in the mounting plate 452 slightly above the pair of vertical openings 459. In a typical embodiment, the pair of pilot holes 403 allows a user to mark a location of required mounting holes in, for example, the movable member 106 prior to installation of the adjustable-striker-bar assembly 450.

Figure 4F:
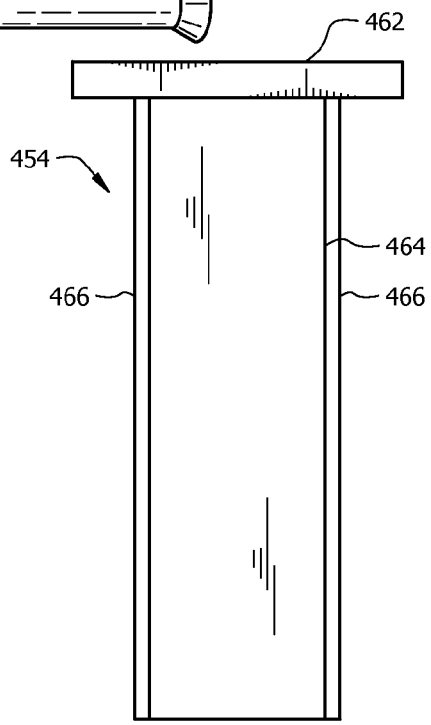
FIG. 4F is a side view of a striker-bar cap for use with the adjustable-striker-bar assembly of FIG. 4D according to an exemplary embodiment.

FIG. 4F is a side view of a striker-bar cap for use with the adjustable-striker-bar cap of FIG. 4D according to an exemplary embodiment. The striker-bar cap 454 includes a top region 462 and a front region 464. The top region 462 is of a width generally equal to a distance between the pair of flanges 458 (shown in FIGS. 4D-4E). The top region 462 is of a depth generally equal to a depth of the pair of flanges 458. The front region 464 is coupled to, and is generally orthogonal to, the top region 462. The front region 464 is of a length generally equal to a length of the mounting plate 452 (shown in FIG. 4D). The striker-bar cap 454 is slidably engaged with the mounting plate 452 such that oppositely-disposed edges 466 of the front region 464 engage the channel 460 (shown in FIG. 4E) formed in each flange of the pair of flanges 458.

Figure 4G:
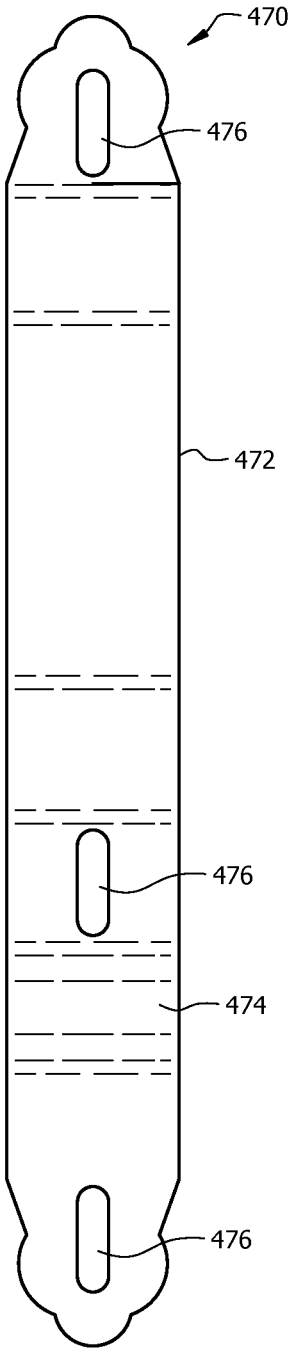
FIG. 4G is a front view of an adjustable handle with slotted holes according to an exemplary embodiment.
Figure 4H:
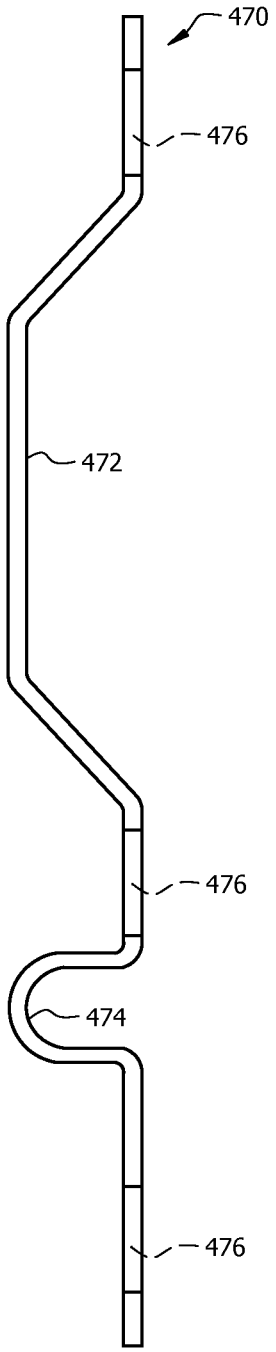
FIG. 4H is a side view of the adjustable handle of FIG. 4G according to an exemplary embodiment.

FIG. 4G is a front view of an adjustable handle with slotted holes according to an exemplary embodiment. FIG. 4H is a side view of the adjustable handle of FIG. 4G according to an exemplary embodiment. Referring now to FIGS. 4G-4H, an adjustable handle 470 includes a grip portion 472, a brace portion 474, and a plurality of slotted holes 476. In a typical embodiment, the adjustable handle 470 is assembled with the adjustable-striker-bar assembly 450 (shown in FIGS. 4D-4F); however, in various embodiments, the adjustable handle 470 may be assembled with the adjustable-striker-bar assembly 104 (shown in FIGS. 4A-4C). A plurality of fastening members such as, for example, a plurality of screws, bolts, lags, rivets, or other fasteners (not explicitly shown) pass through the plurality of slotted holes 476 and secure the adjustable handle 470 to the movable member 106 (shown in FIG. 1). The grip portion 472 provides a hand-hold allowing a user to open or close the movable member 106. In a typical embodiment, the adjustable handle 470 is assembled such that a striker bar such as, for example, the striker bar 455 (shown in FIG. 4B) passes underneath the brace portion 474. In a typical embodiment, the brace portion 474 supports the striker bar 455 and prevents torsional loading of the adjustable-striker-bar assembly 450.

Still referring to FIGS. 4G and 4H, if adjustment of the adjustable-striker-bar assembly 450 (shown in FIGS. 4D-4F) necessitates adjustment of the adjustable handle 470, the plurality of fastening members (not explicitly shown) are sufficiently loosened to allow the adjustable handle 470 to move relative to the movable member 106. The plurality of fastening members are not fully disengaged from the adjustable handle 470 or the movable member 106. The adjustable handle 470 is then positioned to correspond to a position of the adjustable-striker-bar assembly 450. When the adjustable handle 470 is properly positioned, the plurality of fastening members are tightened thereby securing the adjustable handle 470 to the movable member 106.

Figure 4I:
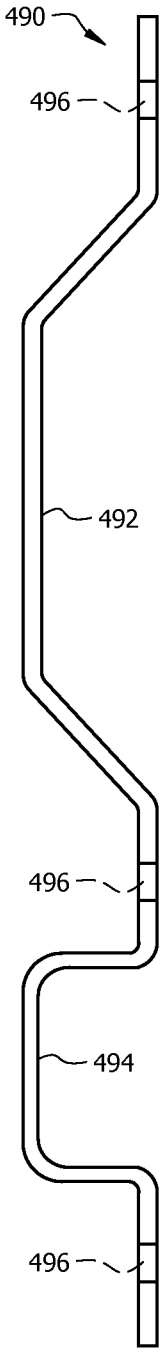
FIG. 4I is a side view of a handle with an elongated brace portion according to an exemplary embodiment.

FIG. 4I is a side view of a handle with an elongated brace portion according to an exemplary embodiment. A handle 490 includes a grip portion 492, a brace portion 494, and a plurality of holes 496. In a typical embodiment, the handle 490 is assembled with the adjustable-striker-bar assembly 450 (shown in FIGS. 4D-4F); however, in various embodiments, the handle 490 may be assembled with the adjustable-striker-bar assembly 104 (shown in FIGS. 4A-4C). A plurality of fastening members (not explicitly shown) pass through the plurality of holes 496 and secure the handle 490 to the movable member 106 (shown in FIG. 1). The grip portion 492 provides a hand-hold allowing a user to open or close the movable member 106. In a typical embodiment, the handle 490 is assembled such that a striker bar such as, for example, the striker bar 455 (shown in FIG. 4B) passes underneath the brace portion 494. In a typical embodiment, the brace portion 494 supports the striker bar 455 and prevents torsional loading of the adjustable-striker-bar assembly 450. In the embodiment illustrated in FIG. 4I, the brace portion 494 is elongated. The elongated brace portion 494 allows adjustments to be made to a position of the striker bar 455. Thus, the adjustable-striker-bar assembly 450 may be adjusted without the need to adjust the handle 490.

Figure 5:
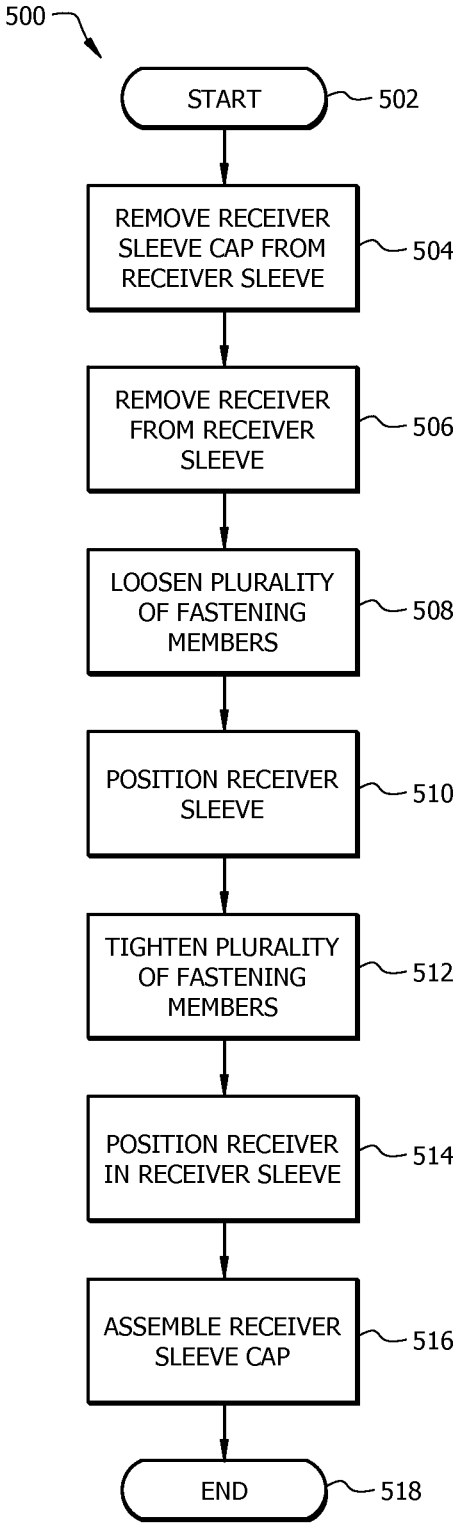
FIG. 5 is flow diagram of a process for adjusting an adjustable-receiver assembly according to an exemplary embodiment.

FIG. 5 is flow diagram of a process for adjusting an adjustable-receiver assembly according to an exemplary embodiment. A process 500 will now be discussed relative to FIGS. 2-3C. The process 500 starts at step 502. At step 504, the receiver-sleeve cap 206 is removed from the receiver sleeve 202. At step 506, the receiver 204 is removed from the receiver sleeve 202. At step 508, the plurality of fastening members 208 are sufficiently loosened to allow the receiver sleeve 202 to move relative to the fixed member 108. At step 510, the receiver sleeve 202 is positioned such that the receiver sleeve 202 is aligned with a striker-bar such as, for example, the adjustable-striker-bar assembly 104. At step 512, the plurality of fastening members 208 are sufficiently tightened to secure the receiver sleeve 202 to the fixed member 108. At step 514, the receiver 204 is positioned in the receiver sleeve 202. At step 516, the receiver-sleeve cap 206 is re-assembled with the receiver sleeve 202. The process 500 ends at step 518.

Figure 6:
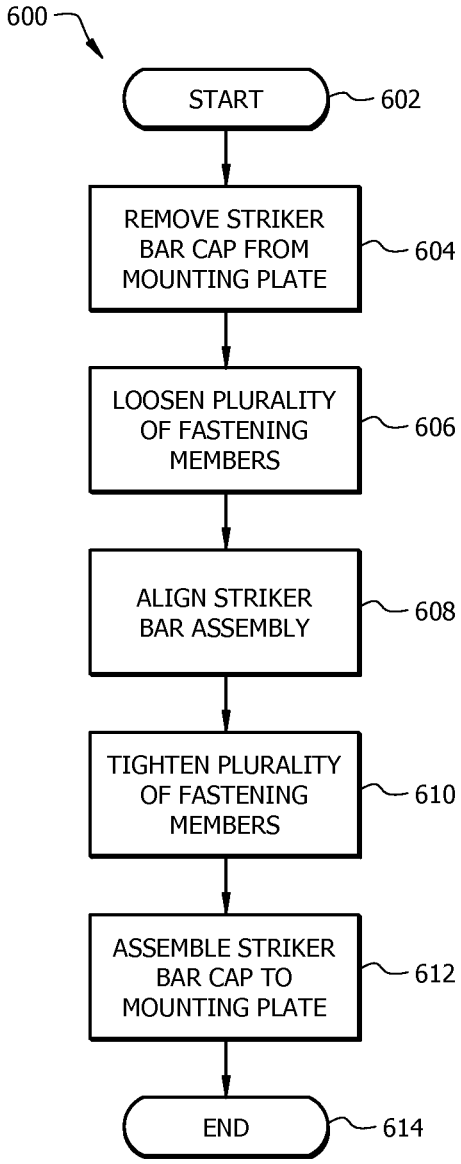
FIG. 6 is a flow diagram of a process for adjusting an adjustable-striker-bar assembly according to an exemplary embodiment.

FIG. 6 is a flow diagram of a process for adjusting an adjustable-striker-bar assembly according to an exemplary embodiment. A process 600 will now be discussed relative to FIGS. 4A-4C. The process 600 begins at step 602. At step 604, a striker-bar cap 404 is removed from the mounting plate 402. At step 606, a plurality of fastening members 411 are sufficiently loosened to allow the mounting plate 402 to move relative to the movable member 106. At step 608, the adjustable-striker-bar assembly 104 is aligned with a receiver, such as for example, the receiver 204. At step 610, the plurality of fastening members 411 are tightened to secure the adjustable-striker-bar assembly 104 to the movable member 106. At step 612, the striker-bar cap 404 is re-assembled to the mounting plate 402. The process 600 ends at step 614. Although the process 600 has been described herein as utilizing the adjustable-striker-bar assembly 104; one skilled in the art will recognize that, in other embodiments, the process 600 may utilize the adjustable-striker-bar assembly 450.

Figure 7A:
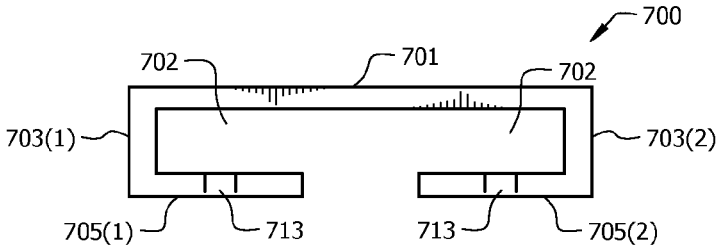
FIG. 7A is top view of a receiver sleeve with securement holes according to an exemplary embodiment.

FIG. 7A is top view of a receiver sleeve with securement holes according to an exemplary embodiment. A receiver sleeve 700 includes a back plate 701, a first side plate 703(1), a second side plate 703(2), a first front plate 705(1) and a second front plate 705(2). The first side plate 703(1) and the second side plate 703(2) are oriented generally orthogonal to the back plate 701. The first front plate 705(1) and the second front plate 705(2) are oriented generally orthogonal to the first side plate 703(1) and the second side plate 703(2), respectively. The first front plate 705(1) and the second front plate 705(2) have a hole 713 formed therein. The back plate 701, the first side plate 703(1), the second side plate 703(2), the first front plate 705(1), and the second front plate 705(2) form a pair of oppositely-disposed channels 702. The pair of oppositely-disposed channels 702 receive corresponding edges of the receiver 204 (shown in FIG. 2) and restrain the receiver 204 from moving in a direction generally orthogonal to the back plate 701. However, the pair of oppositely-disposed channels 702 permit the receiver 204 (shown in FIG. 2) to slidably move in a vertical direction generally parallel to the back plate 701. In a typical embodiment, the receiver sleeve 700 is constructed of a metallic material such as, for example, aluminum, steel, or other metallic material; however, other appropriate rigid materials could be utilized.

Figure 7B:
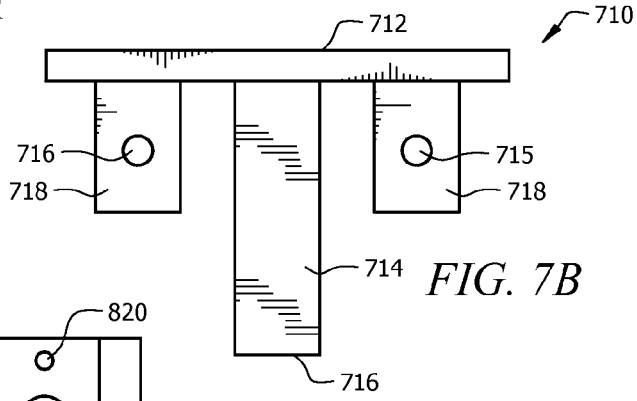
FIG. 7B is a front view of a receiver-sleeve cap with securement holes according to an exemplary embodiment.

FIG. 7B is a front view of a receiver-sleeve cap with securement holes according to an exemplary embodiment. Referring now to FIGS. 7A-7B, a receiver-sleeve cap 710 includes a generally-planar top plate 712 and a vertical plate 714. In a typical embodiment, the generally-planar top plate 712 is of a width approximately equal to a distance between the first side plate 703(1) and the second side plate 703(2) where the generally-planar top plate 712 is of a depth approximately equal to a depth of the first side plate 703(1) and the second side plate 703(2). The vertical plate 714 is coupled generally perpendicularly to the general-planar top plate 712. The vertical plate 714 is of a width approximately equal to a distance between the first front plate 705(1) and the second front plate 705(2). The vertical plate 714 is of a length such that, when the receiver-sleeve cap 710 and the receiver 204 are installed with the receiver sleeve 700, a bottom region 716 of the vertical plate 714 approximately contacts the receiver 204 (shown in FIG. 2).

Still referring to FIG. 7A-7B, a pair of cap guides 718 are coupled generally perpendicularly to the generally-planar top plate 712. The pair of cap guides 718 are disposed slightly behind the vertical plate 714. Each cap guide of the pair of cap guides 718 has a hole 715 formed therein. Upon installation of the receiver-sleeve cap 710 with the receiver sleeve 700, the pair of cap guides 718 engages the pair of oppositely-disposed channels 702 thereby securing the receiver-sleeve cap 710 in place. The hole 713 aligns with the hole 715. A fastener (not shown) such as, for example, a screw, is placed through the hole 713 to engage the hole 715 and the hole 713 thereby preventing accidental removal of the receiver-sleeve cap 710. In a typical embodiment, the hole 713 and the hole 715 are threaded.

Figure 8B:
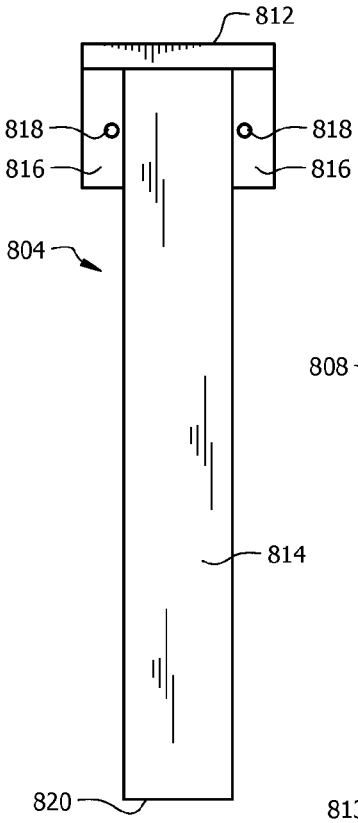
FIG. 8B is a front view of a striker-bar cap with securement holes according to an exemplary embodiment.
Figure 8A:
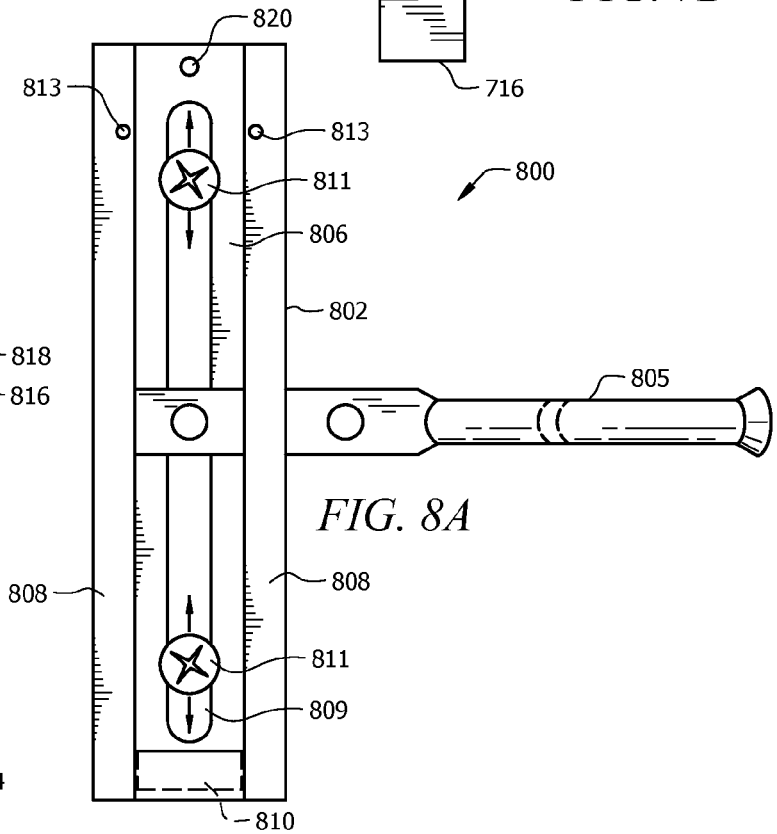
FIG. 8A is a front view of an adjustable-striker-bar assembly with securement holes according to an exemplary embodiment.

FIG. 8A is a front view of an adjustable-striker-bar assembly with securement holes according to an exemplary embodiment. An adjustable-striker-bar assembly 800 includes a mounting plate 802, a striker-bar cap 804 (shown in FIG. 8B) and a striker bar 805. The mounting plate 802, includes a rear plate 806 and a pair of flanges 808. The pair of flanges 808 are generally L-shaped and are oriented generally orthogonal to the rear plate 806. Each flange of the pair of flanges 808 has a hole 813 formed therein. The striker bar 805 extends laterally from the mounting plate 802. A vertical opening 809 is formed in the rear plate 806. A plurality of fastening members 811 extend through the vertical opening 809 and secure the mounting plate 802 to the movable member 106 (shown in FIG. 1). In a typical embodiment, the plurality of fastening members 811 may be, for example, a plurality of screws, lags, bolts, rivets, or other fasteners. In an exemplary embodiment, the mounting plate 802 has a width on the order of approximately 1 inch and a length on the order of approximately 4 inches; however, other dimensional variations may be utilized. A cap-bottom channel 810 is disposed across a front of the mounting plate 802 between the pair of flanges 808. In a typical embodiment, the adjustable-striker-bar assembly 800 is used with fences constructed of materials such as, for example, wrought iron; however, other arrangements could be utilized. A pilot hole 820 is formed in the mounting plate 802 slightly above the vertical opening 809. In a typical embodiment, the pilot hole 820 allows a user to mark a location of required mounting holes in the movable member 106 prior to installation of the adjustable-striker-bar assembly 800.

Figure 8C:
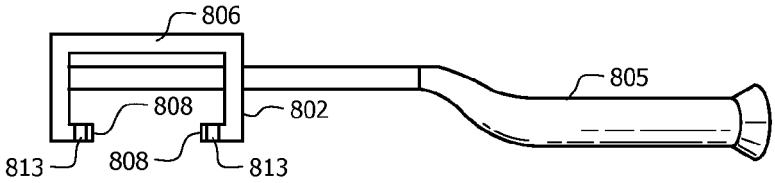
FIG. 8C is a top view of the adjustable-striker-bar assembly of FIG. 8A according to an exemplary embodiment.

FIG. 8B is a front view of a striker-bar cap with securement holes according to an exemplary embodiment. FIG. 8C is a top view of the adjustable-striker-bar assembly of FIG. 8A according to an exemplary embodiment. Referring now to FIGS. 8A-8C, the striker-bar cap 804 includes a generally-planar top plate 812 and a vertical plate 814. The generally-planar top plate 812 is of a width generally equal to a width of the rear plate 806. The generally-planar top plate 812 is of a depth generally equal to a depth of each flange of the pair of flanges 808. The vertical plate 814 is coupled to, and is generally orthogonal to, the generally-planar top plate 812. The vertical plate 814 is of a length generally equal to a length of the mounting plate 802. A pair of cap guides 816 is coupled to the generally-planar top plate 812. The pair of cap guides 816 are disposed slightly behind the vertical plate 814. Each cap guide of the pair of cap guides 816 has a hole 818 disposed therein. Upon installation of the striker-bar cap 804 with the mounting plate 802, the pair of cap guides 816 fit behind the pair of flanges 808. A bottom region 820 of the vertical plate 814 is received into the cap-bottom channel 810. The hole 813 aligns with the hole 818. A fastener (not shown) such as, for example, a screw, is placed through the hole 813 to engage the hole 818 and the hole 813 thereby preventing accidental removal of the striker-bar cap 804. In a typical embodiment, the hole 813 and the hole 818 are threaded.

Figure 9A:
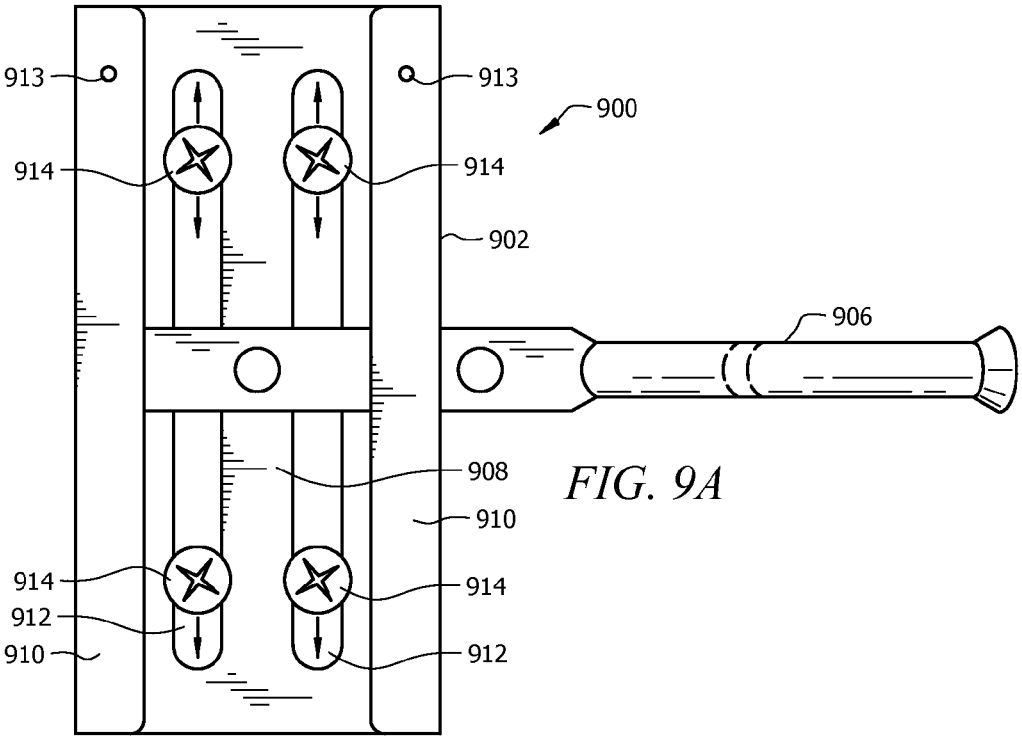
FIG. 9A is a front view of an adjustable-striker-bar assembly with securement holes according to an exemplary embodiment.

FIG. 9A is a front view of an adjustable-striker-bar assembly with securement holes according to an exemplary embodiment. An adjustable-striker-bar assembly 900 includes a mounting plate 902, a striker-bar cap 904 (shown in FIG. 9B), and a striker bar 906. The mounting plate 902 includes a rear plate 908 and a pair of flanges 910. The pair of flanges 910 are generally L-shaped and are oriented generally orthogonal to the rear plate 908. Each flange of the pair of flanges 910 has a hole 913 formed therein. The striker bar 906 extends laterally from the mounting plate 902 in a direction generally orthogonal to the mounting plate 902. A pair of parallel vertical openings 912 are formed in the rear plate 908. A plurality of fastening members 914 extend through the pair of parallel vertical openings 912 and secure the mounting plate 902 to the movable member 106 (shown in FIG. 1). In a typical embodiment, the plurality of fastening members 914 may be, for example, a plurality of screws, lags, bolts, rivets, or other fasteners. In an exemplary embodiment, the mounting plate 902 has a width on the order of approximately 2 inches and a length on the order of approximately 4.5 inches; however, other dimensional variations may be utilized. In a typical embodiment, the adjustable-striker-bar assembly 900 is used with fences constructed of a material such as, for example, wood; however, other arrangements could be utilized.

Figure 9B:
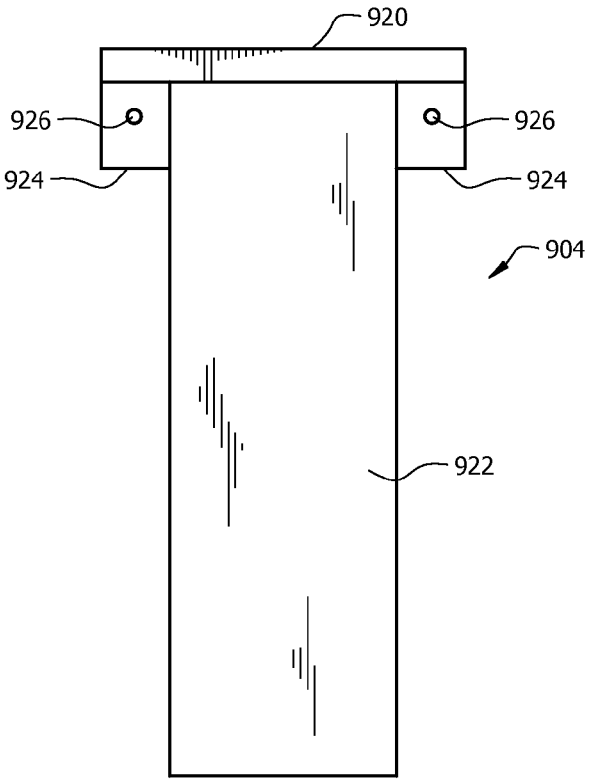
FIG. 9B is a front view of a striker-bar cap for use with the adjustable-striker-bar assembly of FIG. 9A according to an exemplary embodiment.

FIG. 9B is a front view of a striker-bar cap with securement holes according to an exemplary embodiment. Referring to FIGS. 9A-9B, the striker-bar cap 904 includes a generally-planar top plate 920 and a vertical plate 922. The generally-planar top plate 920 is of a width generally equal to a width of the rear plate 908. The generally-planar top plate 920 is of a depth generally equal to a depth of each flange of the pair of flanges 910. The vertical plate 922 depends from, and is generally orthogonal to, the generally-planar top plate 920. The front region 922 is of a length generally equal to a length of the mounting plate 902. A pair of cap guides 924 is coupled to the generally-planar top plate 920. The pair of cap guides 924 are disposed slightly behind the vertical plate 922. Each cap guide of the pair of cap guides 924 has a hole 926 disposed therein. Upon installation of the striker-bar cap 904 with the mounting plate 902, the pair of cap guides 924 fit behind the pair of flanges 910. The hole 913 aligns with the hole 926. A fastener (not shown) such as, for example, a screw, is placed through the hole 913 to engage the hole 926 and the hole 913 thereby preventing accidental removal of the striker-bar cap 904. In a typical embodiment, the hole 913 and the hole 926 are threaded.

Figure 10A:
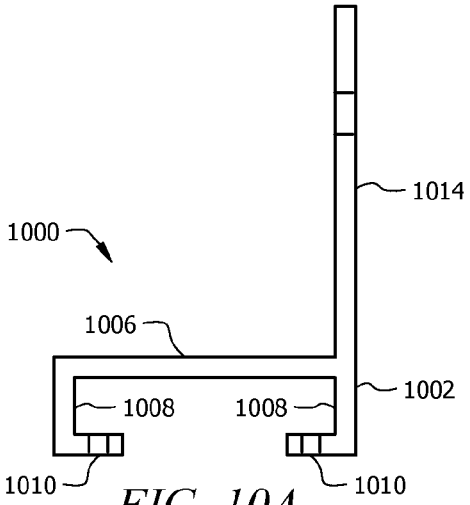
FIG. 10A is a top view of an adjustable-striker-bar assembly with a brace according to an exemplary embodiment.
Figure 10B:
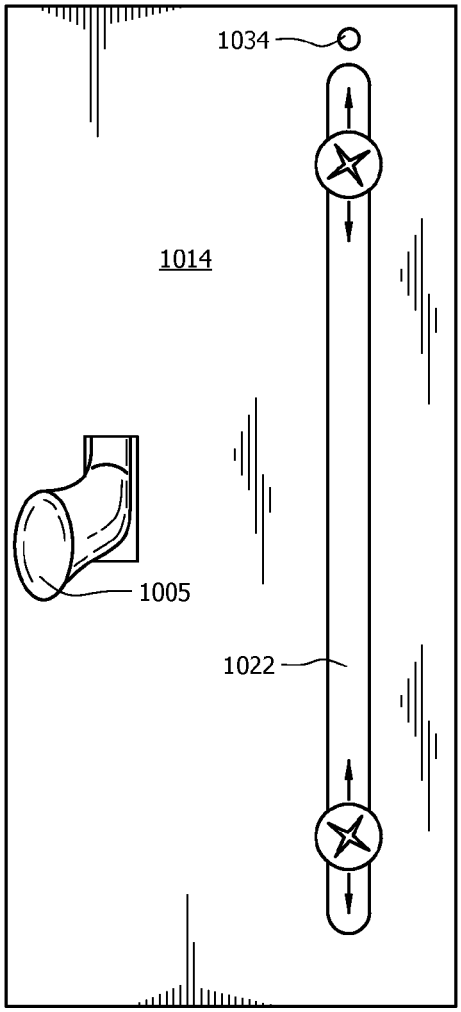
FIG. 10B is a side view of the adjustable-striker-bar assembly of FIG. 10A according to an exemplary embodiment.
Figure 10C:
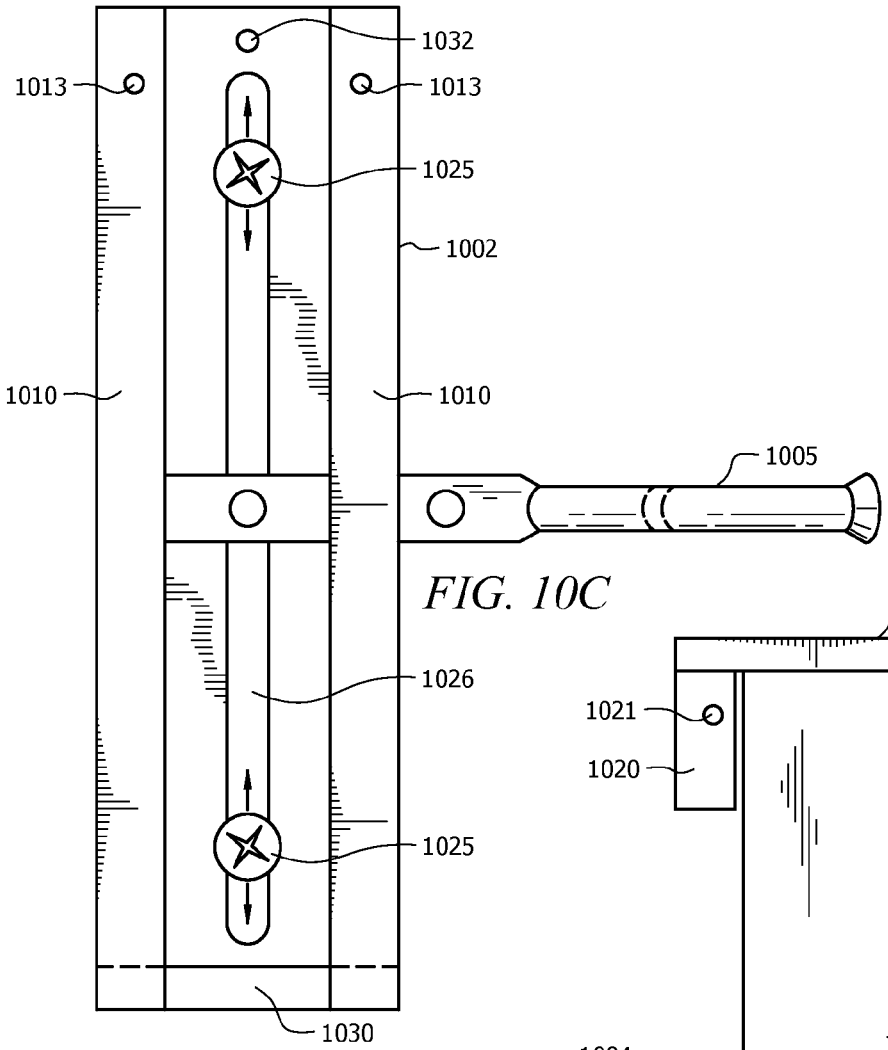
FIG. 10C is a front view of the adjustable-striker-bar assembly of FIG. 10A according to an exemplary embodiment.

FIG. 10A is a top view of an adjustable-striker-bar assembly with a brace according to an exemplary embodiment. FIG. 10B is a side view of the adjustable-striker-bar assembly of FIG. 10A according to an exemplary embodiment. FIG. 10C is a front view of the adjustable-striker-bar assembly of FIG. 10A according to an exemplary embodiment. Referring to FIGS. 10A-10C, an adjustable-striker-bar assembly 1000 includes a mounting plate 1002, a striker-bar cap 1004 (shown in FIG. 10D) and a striker bar 1005. The striker bar 1005 is omitted from FIG. 10A for purposes of clarity. The mounting plate 1002 includes a rear plate 1006, a pair of side plates 1008, and a pair of flanges 1010. The pair of side plates 1008 are oriented generally orthogonal to the rear plate 1006. A brace 1014 is aligned with one side plate of the pair of side plates 1008. The brace 1014 extends rearwardly from the mounting plate 1002.

Still referring to FIGS. 10A-10C, the pair of flanges 1010 are oriented generally orthogonal to the pair of side plates 1008. Each flange of the pair of flanges 1010 has a hole 1013 formed therein. The striker bar 1005 extends laterally from the mounting plate 1002. A vertical opening 1026 is formed in the rear plate 1006. A plurality of fastening members 1025 extend through the vertical opening 1026 and secure the mounting plate 1002 to the movable member 106 (shown in FIG. 1). In an exemplary embodiment, the mounting plate 1002 has a width in the range of approximately 1 inch to approximately 2 inches and a length on the order of approximately 4 inches; however, other dimensional variations may be utilized. A cap-bottom channel 1030 is disposed across a front of the mounting plate 1002 between the pair of flanges 1010. In a typical embodiment, the adjustable-striker-bar assembly 1000 is used with fences constructed of materials such as, for example, wood or wrought iron; however, other arrangements could be utilized.

Still referring to FIGS. 10A-10C, a vertical opening 1022 is disposed in the brace 1014. A plurality of fastening members 1025 extend through the vertical opening and secure the mounting plate 1002 to the movable member 106 (shown in FIG. 1). In a typical embodiment, the brace 1014 absorbs torsional loading resulting from an impact of the striker bar 1005 with the receiver 204 (shown in FIG. 2). A first pilot hole 1032 is formed in the mounting plate 1002 slightly above the vertical opening 1026. A second pilot hole 1034 is formed in the brace 1014 slightly above the vertical opening 1022. In a typical embodiment, the first pilot hole 1032 and the second pilot hole 1034 allow a user to mark a location of required mounting holes prior to installation of the adjustable-striker-bar assembly 1000.

Figure 10D:
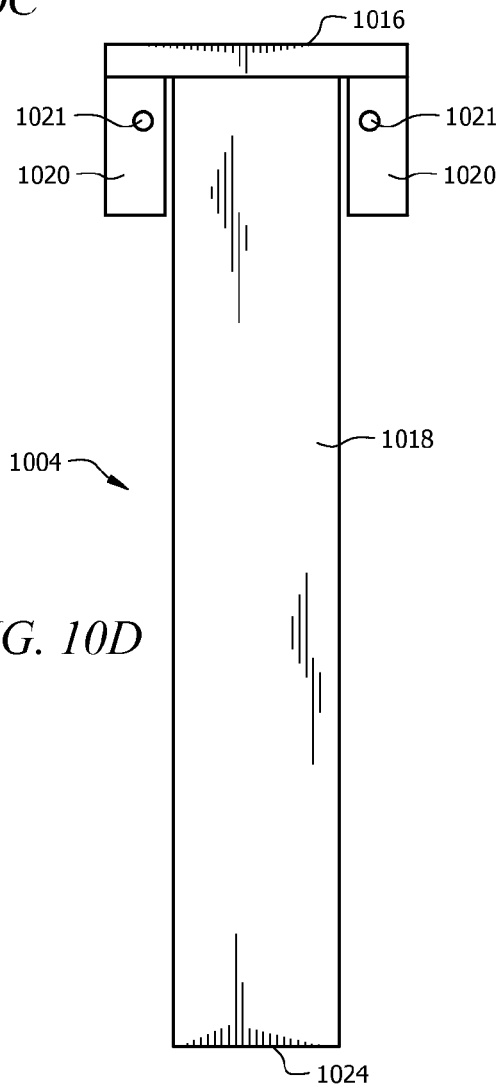
FIG. 10D is a front view of a striker-bar cap for use with the adjustable-striker-bar assembly of FIG. 10A according to an exemplary embodiment.

FIG. 10D is a front view of a striker-bar cap for use with the adjustable-striker-bar assembly of FIG. 10A according to an exemplary embodiment. Referring now to FIGS. 10A-10D, the striker-bar cap 1004 includes a generally-planar top plate 1016 and a vertical plate 1018. The generally-planar top plate 1016 is of a width generally equal to a distance between the pair of side plates 1008. The generally-planar top plate 1016 is of a depth generally equal to a depth of the pair of side plates 1008. The vertical plate 1018 depends from, and is generally orthogonal to, the generally-planar top plate 1016. The vertical plate 1018 is of a length generally equal to a length of the mounting plate 1002. A pair of cap guides 1020 depend from the generally-planar top plate 1016. The pair of cap guides 1020 are disposed slightly behind the vertical plate 1018. Each cap guide of the pair of cap guides 1020 has a hole 1021 disposed therein. Upon installation of the striker-bar cap 1004 with the mounting plate 1002, the pair of cap guides 1020 fit behind the pair of flanges 1010. A bottom region 1024 of the vertical plate 1018 is received into the cap-bottom channel 1030. The hole 1013 aligns with the hole 1021. A screw (not shown) is placed through the hole 1013 to engage the hole 1021 and the hole 1013 thereby preventing accidental removal of the striker-bar cap 1004.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. An adjustable-receiver assembly comprising:

a vertically-movable receiver sleeve, the receiver sleeve comprising:

a rear plate;

a pair of oppositely disposed sidewalls extending forward of the rear plate in a generally perpendicular configuration;

a pair of front plates, each front plate extending from a corresponding sidewall in a direction towards a center of the rear plate;

a flange formed at a bottom of the rear plate between the pair of oppositely disposed sidewalls;

each front plate of the pair of front plates being formed with a groove in an interior edge thereof;

a receiver-sleeve cap, comprising:

a top plate;

a vertical plate coupled to the top plate, comprising oppositely-disposed tapered edges, the vertical plate extending between the pair of front plates such that each tapered edge is received into the groove;

a first plurality of fastening members that mount the vertically-movable receiver sleeve to a fixed member;

a receiver slidably disposed within the vertically-movable receiver sleeve, the receiver resting on the flange;

wherein a vertical position of the vertically-movable receiver sleeve is slidably adjustable relative to the fixed member; and wherein the vertical position of the receiver sleeve is adjusted by loosening the first plurality of fastening members.

2. The adjustable-receiver assembly of claim 1, wherein the vertically-movable receiver sleeve comprises a first hole formed in the front plate.

3. The adjustable-receiver assembly of claim 2, wherein the receiver-sleeve cap comprises:

a cap guide coupled to the top plate; and a second hole formed in the cap guide.

4. The adjustable-receiver assembly of claim 3, comprising a receiver-sleeve fastener that engages the first hole and the second hole and prevents removal of the receiver-sleeve cap.

5. The adjustable-receiver assembly of claim 1, wherein the adjustable-receiver assembly is mounted to a fixed member.

6. An adjustable-striker-bar assembly comprising:

a vertically-movable mounting plate comprising a striker bar extending laterally therefrom;

a pair of oppositely disposed sidewalls extending forward of the vertically-movable mounting plate in a generally perpendicular configuration;

a pair of front plates, each front plate extending from a corresponding sidewall in a direction towards a center of the mounting plate;

each front plate of the pair of front plates being formed with a groove in an interior edge thereof;

a striker-bar cap, comprising:

a top plate;

a vertical plate coupled to the top plate, comprising oppositely-disposed tapered edges, the vertical plate extending between the pair of front plates such that each tapered edge is received into the groove;

a second plurality of fastening members that mount the vertically-movable mounting plate to a fixed member;

a flange oriented generally orthogonal to the vertically-movable mounting plate; and wherein a vertical position of the vertically-movable mounting plate is slidably adjustable relative to the fixed member; and wherein the vertical position of the mounting plate is adjusted by loosening the second plurality of fastening members.

7. The adjustable-striker-bar assembly of claim 6, comprising an adjustable handle disposed with the adjustable-striker-bar assembly.

8. The adjustable-striker-bar assembly of claim 7, comprising an elongated brace portion that allows adjustment of the adjustable-striker-bar assembly.

9. The adjustable-striker-bar assembly of claim 7, comprising a plurality of slotted holes disposed centrally in the adjustable handle that allow adjustment of the adjustable handle.

10. The adjustable-striker-bar assembly of claim 6, wherein the vertically-movable mounting plate comprises a first hole formed in at least one front plate of the pair of front plates.

11. The adjustable-striker-bar assembly of claim 10, wherein the striker-bar cap comprises:

a cap guide coupled to the top plate; and a second hole formed in the cap guide.

12. The adjustable-striker-bar assembly of claim 11, comprising a striker-bar fastener that engages the first hole and the second hole and that prevents removal of the striker-bar cap.

13. The adjustable-striker-bar assembly of claim 6, comprising a brace coupled to the vertically-movable mounting plate and extending rearwardly from the vertically-movable mounting plate.

14. The adjustable-striker-bar assembly of claim 6, wherein the adjustable-striker-bar assembly comprises a pilot hole formed in the vertically-movable mounting plate.

15. The adjustable-striker-bar assembly of claim 6, wherein the adjustable-striker-bar assembly is mounted to a movable member.

16. A method for adjusting an adjustable-receiver assembly, the method comprising:

removing a receiver-sleeve cap from a receiver sleeve, the receiver sleeve comprising:

a rear plate;

a pair of oppositely disposed sidewalls extending forward of the rear plate in a generally perpendicular configuration;

a pair of front plates, each front plate extending from a corresponding sidewall in a direction towards a center of the rear plate;

a flange formed at a bottom of the rear plate between the pair of oppositely disposed sidewalls;

each front plate of the pair of front plates being formed with a groove in an interior edge thereof;

the receiver-sleeve cap, comprising:

a top plate;

a vertical plate coupled to the top plate, comprising oppositely-disposed tapered edges, the vertical plate extending between the pair of front plates such that each tapered edge is received into the groove;

removing a receiver from the receiver sleeve, the receiver resting on the flange;

loosening a first plurality of fastening members to allow vertical adjustment of the receiver sleeve;

adjusting a vertical position of the receiver sleeve relative to a fixed member;

positioning the receiver sleeve relative to a striker bar;

tightening the first plurality of fastening members to secure the receiver sleeve;

placing the receiver within the receiver sleeve; and assembling the receiver-sleeve cap to the receiver sleeve.

17. The method of claim 16, wherein said removing the receiver-sleeve cap comprises removing a second plurality of fasteners that secure the receiver-sleeve cap to the receiver sleeve.

18. The method of claim 16, comprising securing the receiver-sleeve cap to the receiver sleeve via a second plurality of fasteners.

* * * * *